US009067294B2

(12) United States Patent
Everett et al.

(10) Patent No.: US 9,067,294 B2
(45) Date of Patent: Jun. 30, 2015

(54) COATING REMOVAL APPARATUS

(75) Inventors: Robert C. Everett, Burlington, CT (US); Jason W. Pinckert, Newington, CT (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 606 days.

(21) Appl. No.: 13/307,261

(22) Filed: Nov. 30, 2011

(65) Prior Publication Data

US 2013/0137345 A1 May 30, 2013

(51) Int. Cl.

| | |
|---|---|
| ***B24B 21/00*** | (2006.01) |
| ***B24B 27/033*** | (2006.01) |
| ***B24B 19/14*** | (2006.01) |
| ***B24B 21/16*** | (2006.01) |

(52) U.S. Cl.

CPC ..... *B24B 27/033* (2013.01); *B24B 19/14* (2013.01); *B24B 21/165* (2013.01)

(58) Field of Classification Search

CPC ..... B24B 21/165
USPC ..... 451/296, 299, 309, 451, 355
See application file for complete search history.

(56) References Cited

U.S. PATENT DOCUMENTS

| | | | | |
|---|---|---|---|---|
| 5,097,636 | A * | 3/1992 | Crouch et al. | 451/456 |
| 5,193,314 | A * | 3/1993 | Wormley et al. | 451/5 |
| 6,135,866 | A * | 10/2000 | Wang | 451/296 |
| 7,029,367 | B2 | 4/2006 | Bouillot et al. | |
| 7,264,538 | B2 | 9/2007 | Hood et al. | |
| 2008/0006301 | A1 | 1/2008 | Garry et al. | |
| 2010/0003894 | A1 | 1/2010 | Miller et al. | |

FOREIGN PATENT DOCUMENTS

| | | |
|---|---|---|
| DE | 4341498 | 6/1995 |
| WO | 2010/031696 | 3/2010 |

OTHER PUBLICATIONS

Singapore Search Report for Singapore Patent Application No. 201206841-7 completed Sep. 10, 2013.

* cited by examiner

*Primary Examiner* — Maurina Rachuba
(74) *Attorney, Agent, or Firm* — Carlson, Gaskey & Olds, P.C.

(57) ABSTRACT

An example coating removal apparatus for a component includes a table having a first platform disposed along an axis. The platform is arranged to receive at least one fixture for holding a corresponding component. The coating removal apparatus also includes a removal device having a web. The table is slidably moveable in an axial direction and configured to move the fixture a pre-determined distance such that at least one portion of the component contacts the web to remove a coating of the component.

22 Claims, 7 Drawing Sheets

COATING REMOVAL APPARATUS

BACKGROUND

This disclosure relates to a coating removal apparatus, and more specifically a coating removal apparatus for removing protective coatings from gas turbine engine components.

During the manufacture and repair of gas turbine engine components, a coating process is undertaken to provide various characteristics to the components, including increased hardness and heat resistance. When coating a component, excess coating can build up on portions of the components. As a result, the components may not meet required specification tolerances for insertion and use within a gas turbine engine. After the coating process is finished, the coating may be equivalent in hardness to the material of the component itself.

Tools, such as stones and blenders have been used to remove excess coating, but may result in nonconforming parts due to uneven surfaces created by hand blending, and may affect the surface of the component itself.

SUMMARY

An example coating removal apparatus for a component includes a table having a first platform disposed along an axis. The platform is arranged to receive at least one fixture for holding a corresponding component. The coating removal apparatus also includes a removal device having a web. The table is slidably moveable in an axial direction and configured to move the fixture a pre-determined distance such that at least one portion of the component contacts the web to remove a coating of the component.

An example coating removal apparatus for a turbine engine component includes a table having a first platform and second platform disposed along an axis and at least one fixture for holding one of a corresponding turbine blade and turbine vane. The first platform and the second platform are arranged to receive the at least one fixture. The coating removal apparatus includes a removal device having a web. The table is slidably moveable in an axial direction and configured to move the fixture a pre-determined distance such that at least one portion of the component contacts the web to remove excess coating of the component. The fixture orients the at least one portion of the corresponding turbine blade and turbine vane having excess coating to be aligned with the removal device.

An example method for removing a coating from a component includes arranging a fixture on at least one platform of a table disposed along an axis where the fixture is adapted to hold a component. A component is provided to be held by the fixture. The orientation of the component corresponds to the fixture. The component is clamped to the fixture. The platform slides a predetermined axial distance to move the fixture such that at least one portion of the component having excess coating contacts a removal device having a web configured to remove the excess coating of the component.

These and other features of the disclosure can be best understood from the following specification and drawings, the following of which is a brief description.

DETAILED DESCRIPTION

Figure 1:
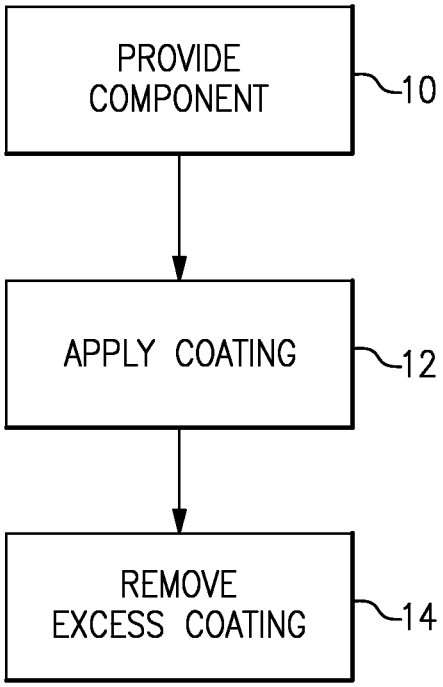
FIG. 1 shows the steps of an example manufacture and/or repair process.

Referring to FIG. 1, a method of manufacturing or repairing a component is shown. A component is provided that is ready to be a coated (step 10). A coating is applied to the component (step 12). After a known coating process is completed, excess coating is removed from the component (step 14) as will be discussed infra.

In one example, the coating provided at step 12 is metallic. However, other types of coatings may be used. In one example, when the coating is provided at step 12, there is overspray such that excess coating is provided on the component and the excess coating has a thickness of about 0.0125 in (0.032 cm).

Figure 2:
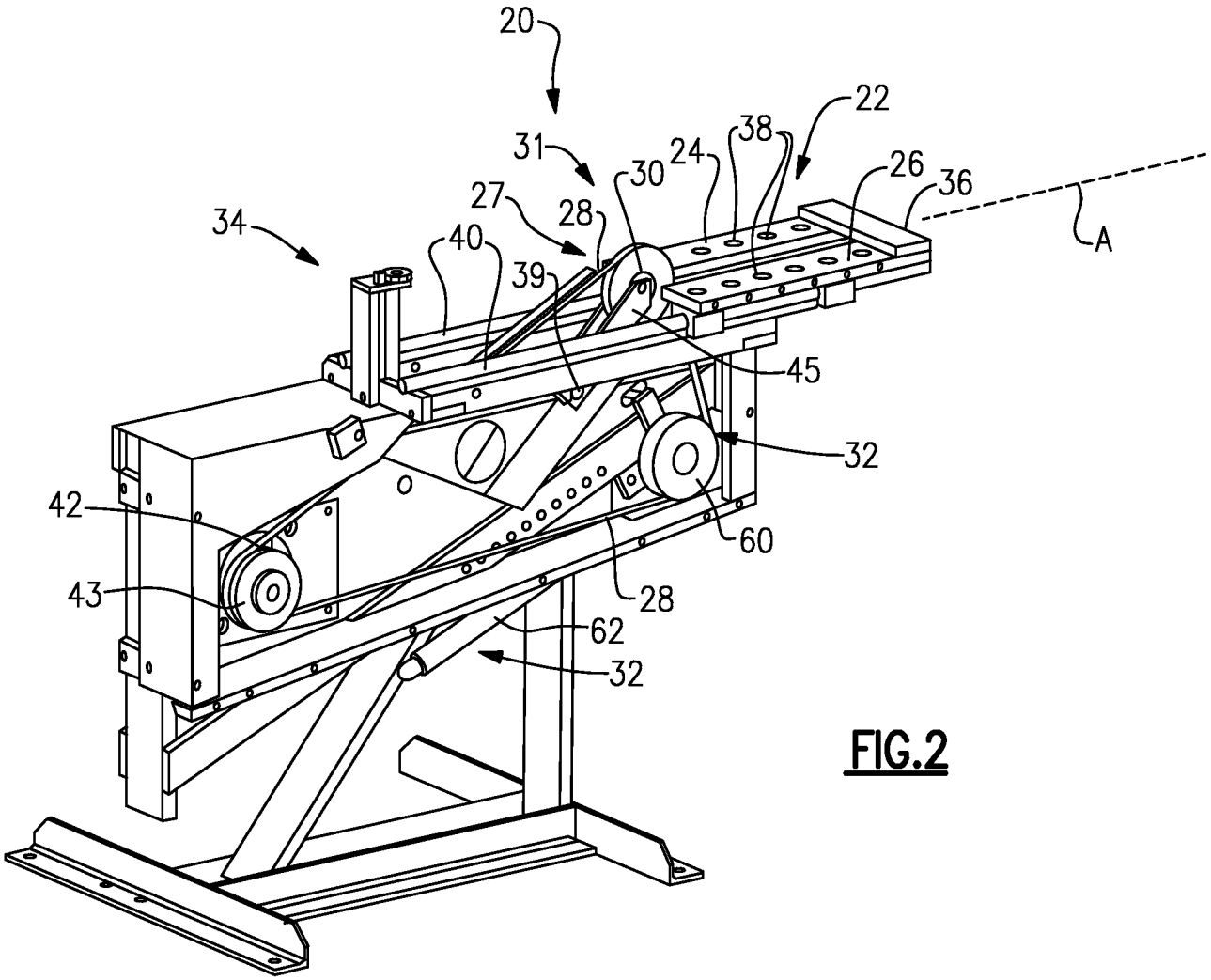
FIG. 2 is a perspective view of a partially assembled coating removal apparatus.

Referring to FIG. 2, a coating removal apparatus 20 is shown that is capable of performing the step of removing the excess protective coating step 14 (see FIG. 1). The coating removal apparatus 20 includes table 22 having a first platform 24 and a second platform 26, a removal device 27 including a web 28 moving about wheel 30, a tensioning mechanism 32, and an alignment mechanism 34. Table 22, web 28, and wheel 30 are generally aligned along axis A. First platform 24 and second platform 26 are generally parallel and disposed on either side of wheel 30 such that platforms 24, 26 slidably move axially adjacent to the wheel 30. Platforms 24, 26 are connected by attachment bar 36. Each of platforms 24, 26 include a plurality of holes 38 for receiving a corresponding button of a fixture, as will be described in further detail below. Platforms 24, 26 of table 22 are disposed for axial movement on rods 40.

Web 28 of the removal device 27 is disposed about a wheel 30, wheel 60 of tensioning mechanism 32 and a drive wheel 43 of motor 42. Motor 42 moves web 28 about wheel 30 and tensioning mechanism 32 such that wheel 30 of removal device 27 and wheel 60 of tensioning mechanism 32 rotate in the process. In one example, the web 28 is a belt having a diamond or other abrasive type coating that can remove excess coating as it rotatably contacts a component 110, 124 (Shown in FIGS. 6A, 6B).

Wheel 30 is pivotably attached to mount 39 via holders 45. Mount 39, part of adjustment mechanism 34, is disposed in coating removal apparatus 20 to attach wheel 30 to the coating removal apparatus 20. Holders 45 are arranged to move wheel 30 perpendicular to axis A.

Figure 3:
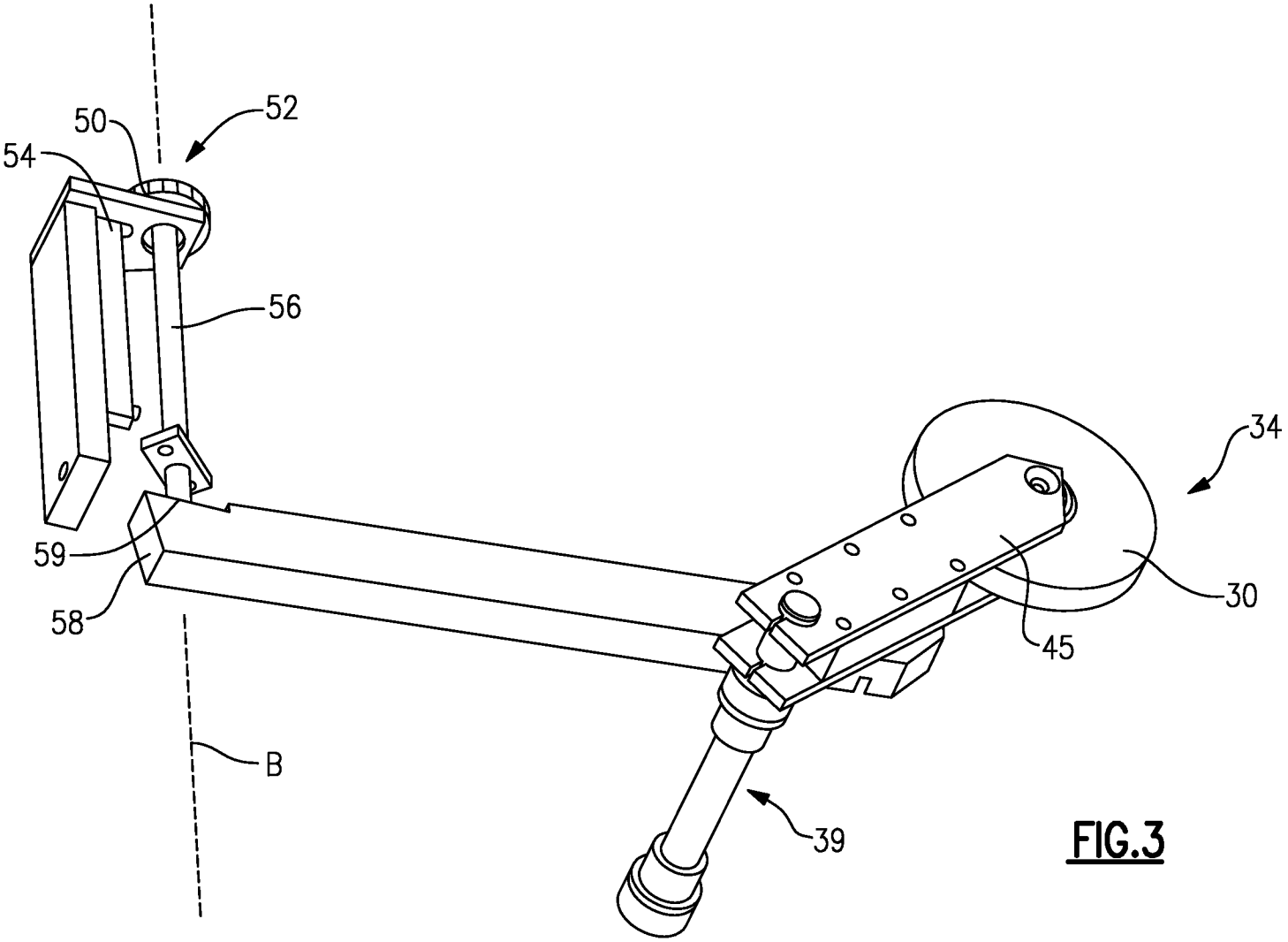
FIG. 3 is a perspective view of an adjustment mechanism of the component removal apparatus of FIG. 2.

Referring to FIG. 3 with continued reference to FIG. 2, an example adjustment mechanism 34 of the coating removal apparatus 20 is shown. The adjustment mechanism 34 includes a knob 52 with serrated edges 50 and a pin 54. Knob 52 is attached to screw 56, which contacts bar 58 such that screw 56 moves bar 58 along axis B. Bar 58 in turn is pivotably attached to holders 45. Holders 45 are spaced apart via mount 39. Bar 58 is configured to raise and lower wheel 30 via holders 45 in response to turning of knob 52. When knob 52 is turned in a first direction, screw 56 is moved downward and pushes down on bar 58 at end 59 opposite knob 52, raising wheel 30. When knob 52 is turned in a second direction opposite the first direction, screw 56 moves upward and allowing bar 58 to move upward and lower wheel 30.

Each serration formed on the serrated edge 50 of the knob 52 is configured to receive pin 54. In this example, turning knob 52 such that pin 54 is displaced moves from one serration to an adjacent serration causes a vertical movement of wheel 30 and screw 56 of removal device 27. In one example, movement from one serration to the adjacent serration causes vertical movement of wheel 30 of 0.0003 in (0.000762 cm). However, other vertical movement settings may be used. The serrated edge 50 and receiving pin 54 allow for fine tuning adjustment of the height of the wheel 30 relative to the table 22. The operator is able to move the knob 52 relative to the pin to determine the vertical adjustment of wheel 30 to determine the amount of excess coating to remove in conjunction with the axial movement of table 22, as will be discussed in further detail.

Figure 4:
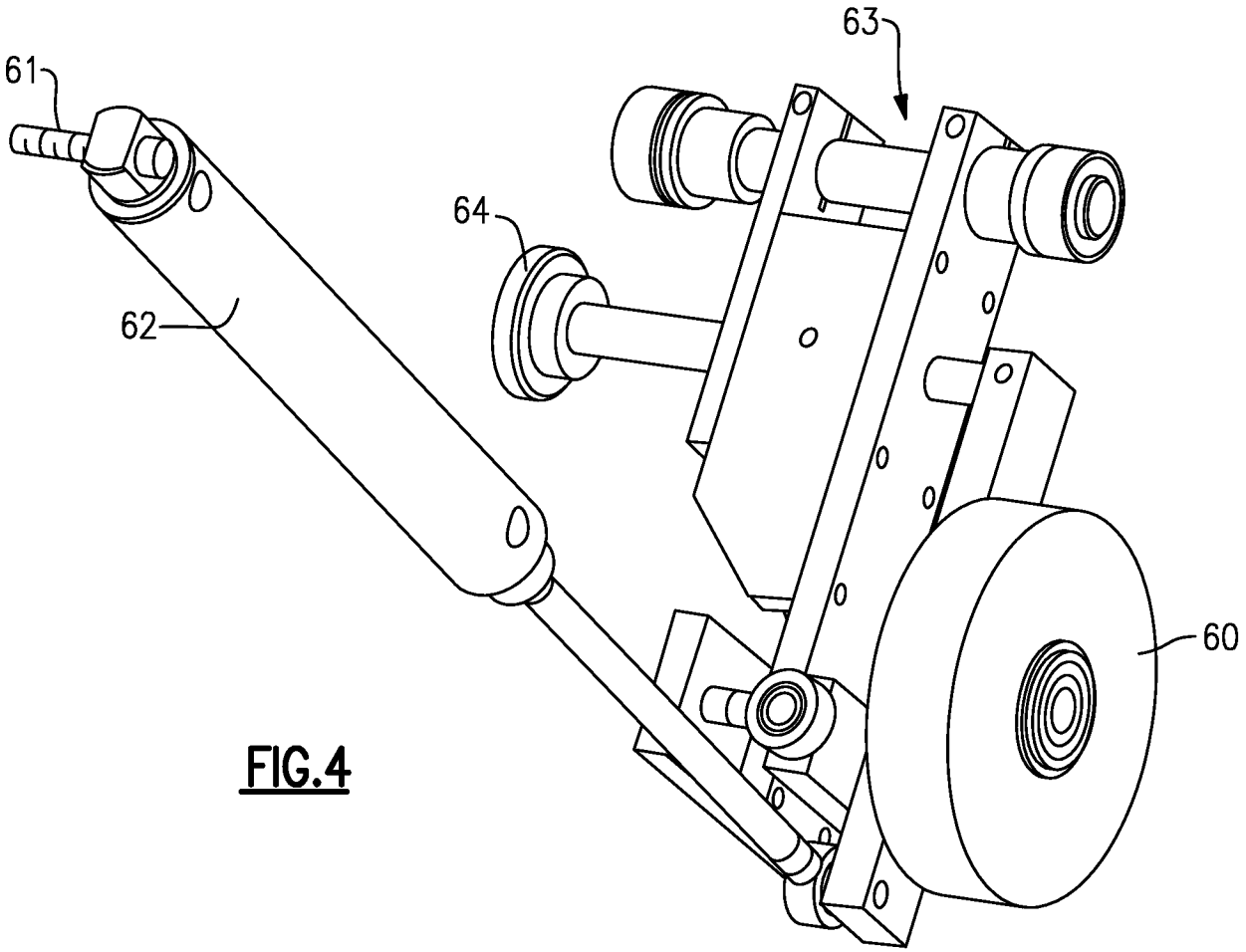
FIG. 4 is a perspective view of a tensioning mechanism used with the coating removal apparatus of FIG. 2.

Referring to FIG. 4 with continued reference to FIG. 2, an example tensioning mechanism 32 is shown and includes the wheel 60, a cylinder 62, and a knob 64. Web 28 (FIG. 2) moves about wheel 60 to be properly tensioned and aligned. Tensioning mechanism 32 is attached to coating removal apparatus 20 via pin 61 and mount 63. Cylinder 62 retracts and pulls wheel 60 in a first direction to loosen the web 28, or pushes wheel 60 in a second direction to tighten the web 28. In this way, web 28 (not shown) can be tensioned as required for a particular cycle as well as removed for replacement with a new web 28. Knob 64 provides for adjustment of wheel 60 in relative to web 28 such that web 28 is aligned and tensioned as desired on wheel 60, thereby preventing web 28 from moving off of wheel 60 and preventing slack within web 28, as well as avoiding slippage of the web 28.

In this example, cylinder 62 is an air cylinder. However, other mechanisms may be used in place of cylinder 62 to move wheel 60 and tension web 28.

Figure 5:
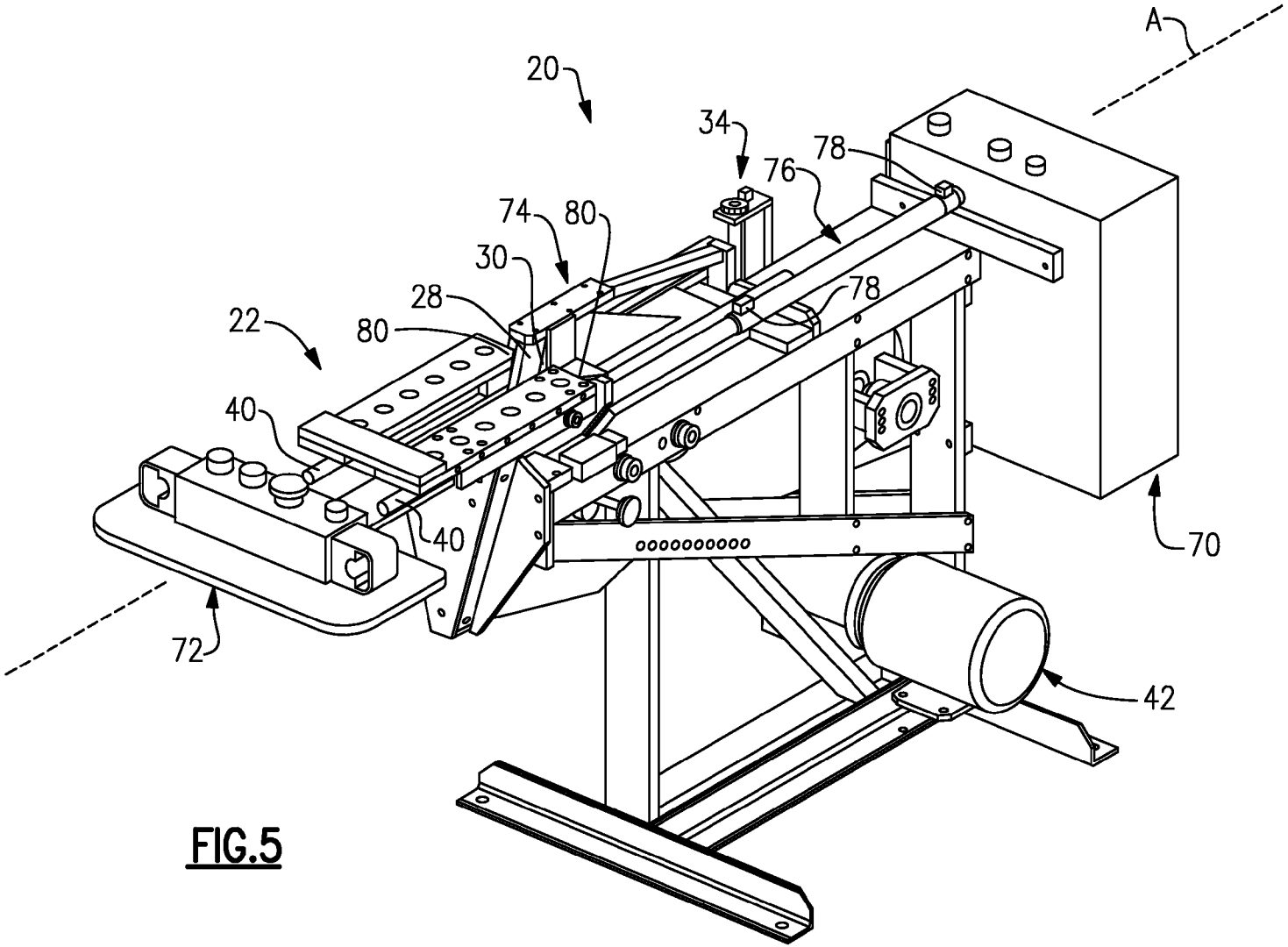
FIG. 5 is a perspective view of the coating removal apparatus of FIG. 2, fully assembled.

Referring to FIG. 5 with continued reference to FIG. 2, the coating removal apparatus 20 further includes electrical enclosure 70, operating console 72, wheel guard 74, and cylinder 76. In this example, cylinder 76 is an air cylinder. However other cylinders 76 may be used. Motor 42 operates to rotate drive wheel 43 which in turn rotates web 28. Cylinder 76 is mounted to at least one platform 24, 26 of table 22 to provide axial motion of the table 22 along axis A as the cylinder 76 cycles. The cylinder 76 includes switches 78, such as reed switches, to sense the position of cylinder 76, such that when switches 78 sense the completion of forward axial movement of the air cylinder 76, the air cylinder 76 returns to the original position, in turn returning table 22 to the original position such that the operator can retrieve the component 110, 124 (See FIGS. 6A, 6B) and a cycle is completed. Operator console 72 and electrical enclosure 70 allow the operator to control and pre-set movement of the table 22 such that fixtures 102, 120 (See FIGS. 6A, 6B) and corresponding components 110, 124 are moved to contact removal device 27 thereby sanding excess coating off of the corresponding components 110, 124 via removal device 27.

A component 110, 124 will have an undesirable coating thickness including overspray of coating required to overlay the component 110, 124. Component 110, 124 also has a desirable coating thickness that is predetermined such that the all excess coating on the component 110, 124 is removed. The operator is able to control the table 22 through a series of cycles until the corresponding component 110, 124 has been sanded by the web 28 of the removal device 27 to remove excess coating such that the desirable thickness of coating remains. The operator is able to use adjustment mechanism 34 to change the height of the wheel 30 and determine the amount of excess coating to remove, based at least in part on the fixture 102, 120 and component 110, 124 having excess coating removed. In this way, an operator is able to predetermine a distance the table 22 should move axially and the height of wheel 30 for a given component 110, 124 such that the component 110, 124 in the corresponding fixture 102, 120 contacts the rotating web 28, thereby removing excess coating in one cycle such that the component 110, 124 has a desirable thickness of coating.

In this example, one cycle is defined as axially moving the table towards the web 28 and then away from the web 28 a single time. However, other cycles or numbers of cycles may be used to allow for removal of excess coating from different components 110, 124. By predetermining the distance table 22 must travel for any given cycle, the excess coating of numerous components 110, 124 having a corresponding fixture 102, 120 can be completed without manual operation and variables in the axial movement of table 22.

The removal device 27 includes a wheel guard 74 disposed about web 28 and wheel 30. The wheel guard 74 prevents unintentional contact between web 28 and component 110, 124 as well as web 28 and operator. Wheel guard 74 extends over wheel 30 and web 28 and is disposed on rods 40. Wheel guard 74 contacts table 22 at portions 80 disposed on rods 40 such that axial movement of the table 22 pushes wheel guard 74 along axis A and allowing components to contact web 28 which is no longer inaccessible. As table 22 returns to its original position, wheel guard 74 returns back in place to cover web 28 and wheel 30.

Although the example coating removal apparatus 20 includes automatic cycling, it is also within the contemplation of this disclosure for coating removal apparatus 20 to not include electrical enclosure 70, operator console 77, and air cylinder 76, as shown in FIG. 5. In another example, the operator manually moves table 22 such that a component 110, 124 contacts web 28 to remove excess coating.

Figure 6A:
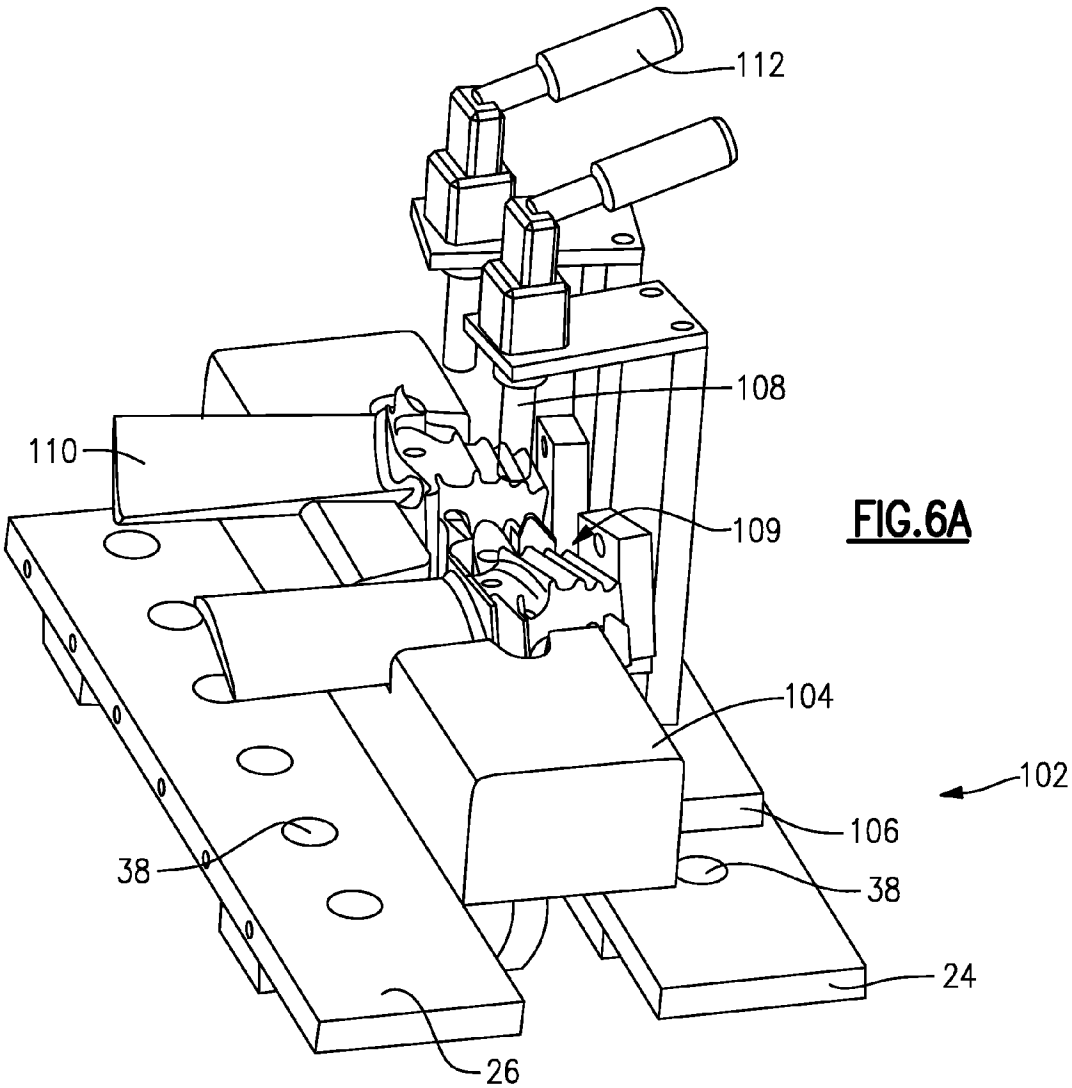
FIG. 6A is a perspective view of an example fixture for use with the coating apparatus of FIG. 2.

Referring to FIG. 6A with continued reference to FIGS. 2 and 5, an example fixture 102 is shown. Fixture 102 includes holder 104, base 106, and clamps 108. Each holder 104 is designed to receive one or more particular components 110 and orient the components 110 for repeated use with the same cycle of the coating removal apparatus 20. The fixture 102 includes buttons 130 (see FIG. 6B) on the bottom of base 106 which are configured to be received by the plurality of holes 38 on the first platform 24 and second platform 26. Once a component 110 is disposed in the holder 104, clamps 108 are actuated using handles 112 to lower clamp 108 from a unengaged position to an engaged position such that clamp 108 retains component 110 against holder 104 to maintain proper orientation during the cycle. The component 110 is disposed in the holder 104 such that the surface having excess coating is flat with respect to wheel 30 and is arranged to pass over wheel 30. In this example, component 110 is a gas turbine engine blade.

In this example, two components 110 are shown in respective holder 104. However, a single component 110 or more than two components 110 may be used with a single fixture 102. As shown, components 110 may be rotated within holder 104 such that opposing sides of the component 110 may have excess coating removed. Alternatively, fixture 102 may be moved from platform 24 to platform 26 to remove excess coating from other portions of the component 110. Once the operator is able to determine the axial distance the table 22 moves and height of wheel 30 for a given fixture 102, the operating console 77 allows the operator to pre-set the axial movement of the table 22 such that the fixture 102 and component 110 can be automatically run on the coating removal apparatus 20.

Figure 6B:
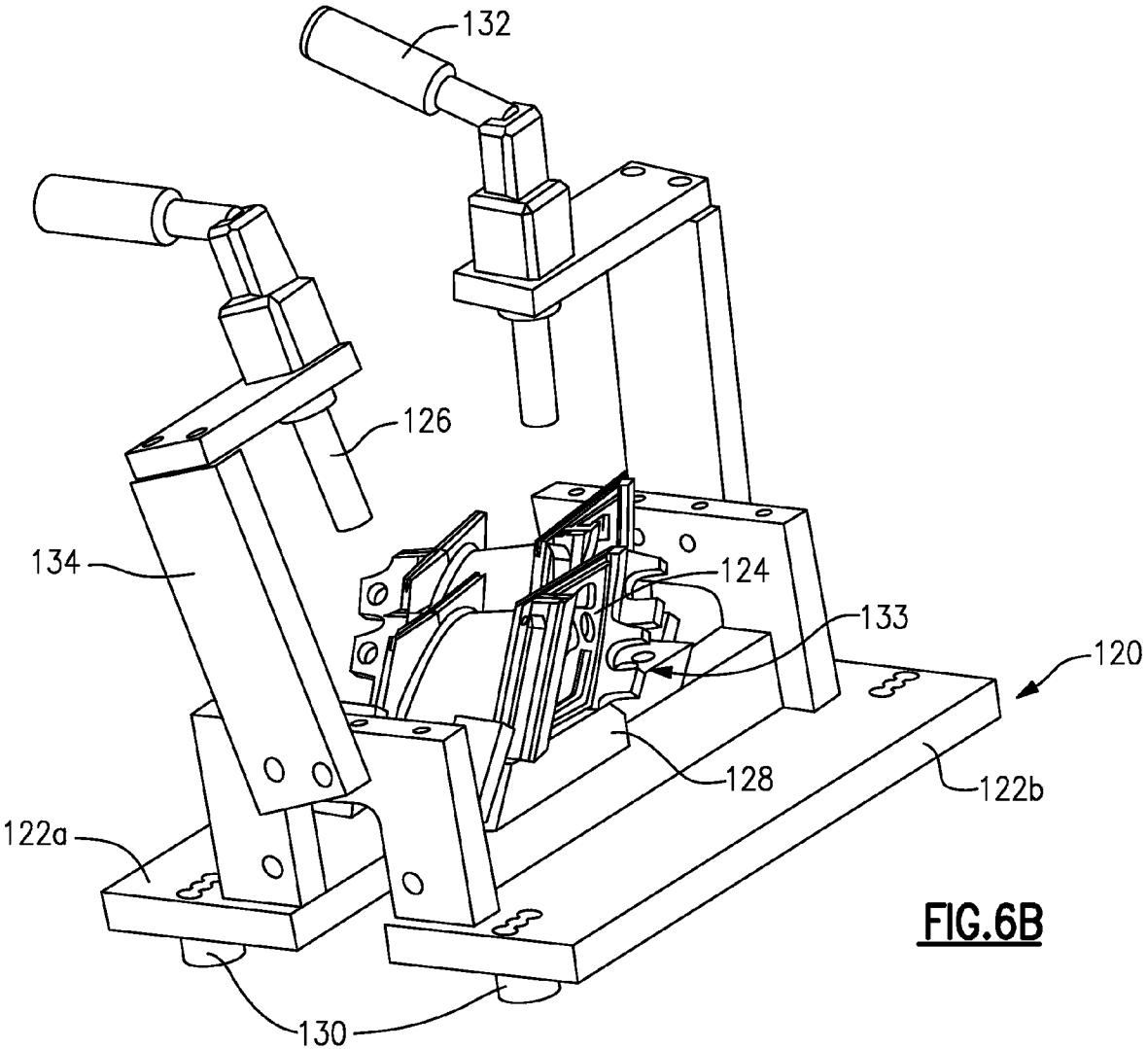
FIG. 6B is a perspective view of another example fixture for use with the coating apparatus of FIG. 2.

Referring to FIG. 6B, with continued reference to FIGS. 2, 5 and 6A, another example fixture 120 is shown. Fixture 120 includes base 122*a*, 122*b* component 124, clamps 126 and holder 128. In this example, component 124 is received by holder 128 such that the component 124 is oriented to remove excess coating via contact with web 28. In this example, fixture 120 includes base 122*a* and base 122*b*. Each base 122*a*, 122*b* includes a plurality of buttons 130 which correspond to holes 128 on platforms 24, 26 (see FIG. 6A). Buttons 130 are inserted into holes 128 to align fixture 120 on the table 22. In this example, two bases 122*a*, 122*b* are used and correspond to platforms 24, 26 such that the fixture 120 is mounted to both platforms 24, 26 of the table 22. The component 124 is disposed in the holder 128 such that the surface having excess coating is flat with respect to wheel 30 and is arranged to pass over wheel 30. Once the operator is able to determine the axial distance the table 22 moves for a given fixture 120, the operating console 77 allows the operator to pre-set the axial movement of the table 22 such that the fixture 120 and component 124 can be automatically run on the coating removal apparatus 20.

The components 124 are held in place by clamp 126. The clamps 126 are actuated by handles 132. Additionally, handles 132 are disposed over component 124 which allows for proper alignment of the clamps 126 for the particular component 124 when moved from a disengaged position to an engaged position. In this example, components 124 are gas turbine engine vanes. A plurality of components 124 may be used. However, it is within the contemplation of this disclosure to have a fixture 120 which holds a single component 124.

Fixtures 102, 120 are made to accommodate the component 110, 124, respectively. Therefore, the same fixture 102, 120 may be used for multiple similar components 110, 124 when added or removed by the operator, providing proper orientation of a component 110, 124 to remove excess coating consistently through each cycle.

Although turbine vanes and blades are shown as example components 110, 124 associated with example fixtures 102, 124, it is within the contemplation of this disclosure to use other fixtures 102, 120 for those components 110, 124 as well as other fixtures 102, 124 for different components 110, 124. Different types of fixtures 102, 120, including mounting on one or both platforms 24, 26, are used with each component 110, 124.

Referring to FIGS. 6A-6B, in one example, the components 110, 124 are turbine blades and turbine vanes, respectively. In this example, the turbine blades are oriented such that only concave and convex sides of platform 109 may contact web 28 for removal of excess coating. The turbine vanes are oriented such that all sides of the platform section 133 may contact web 28 for removal of excess coating.

In operation, the operator chooses a fixture 102, 120 corresponding to the component 110, 124 to have excess coating removed. The fixture 102, 120 is loaded onto table 22 via buttons 130 inserted into holes 28 on platforms 24, 26. Once the operator has secured the fixture 102, 120 on the table 22, components 110, 124 are loaded into respective fixture 102, 120 and secured in place by clamps 112, 132. The operator then turns on motor 42 such that the drive wheel 43 begins rotating the web 28. Operator uses console 72 to move the table 22 towards removal device 27.

If the operator is attempting to establish a single cycle for complete removal of excess coating of a particular fixture 102, 120 and corresponding component 110, 124, the operator will move the table 22 one or more cycles using console 72 until the single cycle is determined such that the distance the table 22 moves to remove excess coating is pre-determined.

If the single cycle has already been determined, the operator will set the coating removal apparatus 20 to move table 22 a predetermined distance of the single cycle such that the table 22 moves a specific distance for removal of excess coating on components 110, 124. The wheel 30 may be adjusted vertically via adjustment mechanism 34 depending on the cycle and fixtures 102, 120 being used.

The operator uses adjustment mechanism 34 to change the height of wheel 30 such that wheel contacts the portion of component 110, 124 having excess coating and, based on the fixture 102, 120 and component 110, 124, establishes the amount of excess coating to remove. Once the height of wheel 30 is determined, it can be pre-set for additional components 110, 124 until a new component 110, 124, or new surface of component 110, 124 needs to be sanded.

Once the air cylinder 76 determines that table 22 has completed movement towards wheel 30, it returns table 22 to its original position completing the cycle. The operator can then remove the components 110, 124 and insert new components 110, 124 for another cycle of removal of excess coating.

Although a preferred embodiment of this disclosure has been provided, a worker of ordinary skill in this art would recognize that certain modifications would come within the scope of this disclosure. For that reason, the following claims should be studied to determine the true scope and content of this disclosure.

What is claimed is:

1. A coating removal apparatus for a component comprising:

a table having a first platform and a second platform disposed along an axis, at least one of the first platform and the second platform arranged to receive at least one fixture for holding a corresponding component; and a removal device having a web, wherein the table is slidably moveable in an axial direction relative to a contact point on the web and configured to move the fixture a pre-determined distance such that at least one portion of the component contacts the web to remove a coating of the component, wherein the first platform and the second platform form a platform opening and at least a portion of the web is configured to extend through the platform opening.

2. The coating removal apparatus of claim 1, wherein the second platform is disposed along the axis parallel to the first platform, the second platform arranged to receive the at least one fixture for holding the corresponding component.

3. The coating removal apparatus of claim 2, wherein the first platform and the second platform move along a parallel first rod and a second rod respectively.

4. The coating removal apparatus of claim 1, wherein the orientation of the corresponding component relative to the web is determined by the fixture.

5. The coating removal apparatus of claim 1, wherein the web is a diamond coated belt.

6. The coating removal apparatus of claim 1, further comprising a mechanism for adjusting the removal device, wherein the removal device moves perpendicular to the axis in response to a setting of the adjustment mechanism.

7. The coating removal apparatus of claim 1, wherein the table is attached to an air cylinder to effectuate movement along the axis.

8. The coating removal apparatus of claim 1, wherein the removal device includes a wheel in communication with the web such that the web moves about a portion of the wheel.

9. The coating removal apparatus of claim 8, wherein the removal device includes a wheel guard at least partially covering the wheel and web.

10. The coating removal apparatus of claim 9, wherein the table contacts the wheel guard and moves the wheel guard axially away from the wheel such that the web is exposed to contact the component.

11. The coating removal apparatus of claim 1, wherein the fixture is mounted to the first platform via buttons.

12. The coating removal apparatus of claim 1, wherein the fixture includes at least one clamp to secure the component to the fixture.

13. The coating removal apparatus of claim 1, wherein the at least one fixture receives at least one additional component.

14. The coating removal apparatus of claim 1, wherein the corresponding component is one of a turbine blade and turbine vane.

15. A coating removal apparatus for a turbine engine component comprising:

a table having a first platform and second platform disposed along an axis;

at least one fixture for holding one of a corresponding turbine blade and turbine vane, the first platform and the second platform arranged to receive the at least one fixture; and a removal device having a web, wherein the table is slidably moveable in an axial direction and configured to move the fixture a pre-determined distance such that at least one portion of the component contacts the web to remove excess coating of the component, wherein the fixture orients the at least one portion of the corresponding turbine blade and turbine vane having excess coating to be aligned with the removal device, wherein the first platform and the second platform form a platform opening and at least a portion of the web is configured to extend through the platform opening.

16. A method for removing a coating from a component comprising:

arranging a fixture on at least one of a first platform and a second platform of a table disposed along an axis, said fixture adapted to hold a component;

providing a component to be held by the fixture, wherein the orientation of the component corresponds to the fixture;

clamping the component to the fixture; and sliding the platform a predetermined axial distance to move the fixture such that at least one portion of the component having excess coating contacts a removal device having a web configured to remove the excess coating of the component, wherein the first platform and the second platform form a platform opening and at least a portion of the web is configured to extend through the platform opening.

17. The method of claim 16, further comprising the step of replacing the component with a second component to be held by the fixture, wherein the second component corresponds to the fixture.

18. The method of claim 16, further comprising the step of adjusting the height of the removal device in relation to the table.

19. The method of claim 16, wherein the fixture is secured on the first platform and the second platform such that the component is oriented between the first platform and the second platform.

20. The method of claim 16, further comprising the step of sanding the excess coating by the web surfaces of the component the web contacts.

21. The coating removal apparatus of claim 1 including a table opening in the table configured to accept at least a portion of the web, wherein the table opening is at least partially aligned with the platform opening.

22. The method of claim 16 wherein the table is slidably moveable in an axial direction relative to a contact point on the web.

* * * * *